United States Patent [19]

Corbett et al.

[11] 4,423,118

[45] Dec. 27, 1983

[54] THICKENED PAPER COATING COMPOSITION

[75] Inventors: Peter J. Corbett, Rheinmuenster, Fed. Rep. of Germany; Martin G. Aschwanden, Zug, Switzerland

[73] Assignee: The Dow Chemical Company, Midland, Mich.

[21] Appl. No.: 294,596

[22] Filed: Aug. 20, 1981

[51] Int. Cl.[3] ..... B32B 23/08

[52] U.S. Cl. ..... 428/514; 427/361; 427/362; 427/363; 427/364; 427/391; 427/392; 428/507; 428/508; 428/511; 524/26; 524/52; 524/53; 524/521; 524/503

[58] Field of Search ..... 427/391, 361, 362, 363, 427/364, 392, 394; 524/52, 53, 26, 521, 503; 428/507, 508, 511, 514

[56] References Cited

U.S. PATENT DOCUMENTS

| | | | |
|---|---|---|---|
| 2,661,309 | 12/1953 | Azorlosa . | |
| 2,893,977 | 7/1959 | Suen | 260/17.4 |
| 2,997,465 | 8/1961 | Krause et al. . | |
| 3,050,486 | 8/1962 | Ritson et al. | 260/29.6 R |
| 3,404,116 | 10/1968 | Pueschner et al. | 260/29.7 |
| 3,949,138 | 4/1976 | Heiser | 428/323 |
| 3,988,522 | 10/1976 | Berstein | 428/323 |
| 4,134,872 | 1/1979 | Lee | 260/29.7 UP |

*Primary Examiner*—Thurman K. Page
*Attorney, Agent, or Firm*—Philip D. Shepherd

[57] ABSTRACT

A coating composition, comprising an aqueous dispersion of a pigment such as clay and a binder such as a latex of a copolymer of styrene and butadiene thickened with a water-soluble copolymer of an $\alpha,\beta$-ethylenically unsaturated carboxylic acid such as acrylic acid, an ethylenically unsaturated carboxamide such as acrylamide and an ethylenically unsaturated monomer having limited solubility in water such as acrylonitrile, is effectively employed in coating paper and other cellulosic web materials.

9 Claims, No Drawings

THICKENED PAPER COATING COMPOSITION

BACKGROUND OF THE INVENTION

This invention relates to coating compositions useful in preparing coated paper and other cellulosic materials, particularly to coating compositions thickened with a water-soluble polymer and to the coated articles prepared therefrom.

In the preparation of paper and other cellulosic web materials, e.g., paperboard, the paper is often coated with a pigment layer to improve the paper's opacity and to impart a smooth and receptive surface for printing. Conventionally, an aqueous suspension of a pigment such as kaolin clay, muscovite mica or calcium carbonate and a binder or adhesive for the clay particles such as starch or a synthetic polymer binder such as polyvinyl alcohol or a latex of a copolymer of styrene and butadiene is applied to the paper by means of high speed coating equipment such as a trailing blade coater. The water applied with the coating is subsequently removed from the coated paper sheet.

To facilitate subsequent printing of the coated paper, the coating is advantageously applied such that the pigment forms a smooth, level, ink-receptive layer which permits a uniform transfer of printing ink and imparts other desirable properties such as a high strength to permit subsequent printing without "picking." Unfortunately, at the high processing speeds economically desirable, the finished coating is often nonuniform as evidenced by streaking, mottling, strike through and a general nonuniformity of the coating weight along the length of the paper sheet.

Heretofore, to increase the coating speeds employed in coating paper and to improve the properties of the coated paper product, various additives have been incorporated in the coating composition. For example, a dispersing agent such as a polyphosphate helps transform the pigment particles into a uniform slurry thereby facilitating higher processing speed. Alternatively, various viscosity modifiers such as methyl cellulose and sodium alginate help control the flow properties of the coating color, thereby improving the smoothness of the pigment layer and other properties of the resulting coated paper. Increases in the processing speeds of the coating operation and improvements in the uniformity of the coating have also been accomplished by modifying the techniques and equipment used in the paper coating operations. While such additives and modifications have improved the properties of the finished paper products as well as permitting increased processing speeds, further uniformity of the pigment coating on the paper substrate is desired.

SUMMARY OF THE INVENTION

Accordingly, one aspect of the present invention is a thickened coating color comprising (1) a coating color of an aqueous dispersion of a pigment and a binder therefor and (2) a water-soluble copolymer different from the binder comprising, in polymerized form, an $\alpha,\beta$-ethylenically unsaturated carboxylic acid, an ethylenically unsaturated amide and a hydrophobic monomer having limited solubility in water which, when homopolymerized, forms a water-insoluble polymer. Said water-soluble polymer is employed in amounts sufficient to thicken the coating color.

In yet another aspect, the present invention is an article coated with the coating color.

Surprisingly, the aqueous solutions of the copolymer thickeners employed in the thickened coating compositions of this invention exhibit relatively low viscosities, are readily handled and can be added directly to a coating color to effectively thicken same. The resulting, thickened coating color exhibits the rheological properties desired for high speed coating operations and are relatively shear stable, i.e., the viscosity of the color is not significantly reduced with time at constant shear. Therefore, the paper coated with such coating color exhibits unexpectedly improved uniformity with reduced occurrences of blade streaks, mottling and the like. In addition, other properties desired of a coated paper such as brightness and ink receptivity are not significantly affected by the addition of the polymer in the coating composition.

The coating composition of this invention are useful in a wide variety of applications, particularly in the coating of paper and other cellulosic web materials.

DETAILED DESCRIPTION OF THE PREFERRED EMBODIMENTS

As used herein, the term "coating color" refers to an aqueous dispersion (including an aqueous slurry and an aqueous suspension) of a pigment and a binder therefor. For the purposes of this invention, both the term "pigment" and the term "binder" are used conventionally and those pigments and binders employed heretofore in the preparation of paper coating compositions are advantageously employed herein. Such materials are well known in the art and reference is made thereto for the purposes of this invention.

In general, pigments employed in the coating color are finely divided materials and include mineral pigments, plastic pigments and mixtures thereof. Representative mineral pigments include the finely divided clays (especially of the kaolin types), mica, calcium carbonate, titanium dioxide, satin white and the like. Pigmentary minerals such as talc, blanc fixe, ochre, carbon black, aluminum powder or platelets can also be employed in minor amounts in conjunction with other pigmentary materials. Plastic pigments are generally characterized as plastic, polymeric particles which have a particle size from about 0.3 to about 0.8 micrometers and are not film-forming, i.e., do not coalesce at the conditions selected to dry or finish the paper. Representative plastic pigments are presented in U.S. Pat. Nos. 3,949,138 and 3,988,522.

In the practice of this invention, the pigment advantageously comprises a clay, preferably of the kaolin type, or a mixture of clay with one or more of the other pigmentary materials. Preferably, a kaolin type clay comprises a predominant portion, i.e., at least about 50 weight percent, of the pigmentary material employed.

In general, the binder (also commonly referred to as an adhesive) is a material which binds the individual pigment particles. Representative binders include casein, starch derivatives, various water-soluble synthetic polymers such as polyvinyl alcohol and water-insoluble, synthetic polymers which are generally prepared in the form of an aqueous dispersion of colloidal size particles of the synthetic polymer, commonly referred to as latexes, such as styrene/butadiene copolymers, acrylic homopolymers and copolymers, vinyl acetate polymers and the like. Of said binders, the synthetic polymers, particularly the water-insoluble polymeric binders are preferred in the practice of the present invention.

In general, for each 100 parts by weight on a dry basis of the pigmentary material, the coating color contains from about 5 to about 30, more preferably from about 10 to about 30 parts by weight dry basis of the binder. Although the amounts of water in the coating color will vary depending on the paper coating equipment and processing techniques being employed, the pigmentary material and binder will generally comprise from about 8 to about 85, more generally from about 30 to about 75, weight percent of the coating color based on the total weight of the pigmentary material, binder and water.

The copolymers useful as the copolymeric thickeners in the present invention are water-soluble, synthetic, addition copolymers of an $\alpha,\beta$-ethylenically unsaturated carboxylic acid, an ethylenically unsaturated carboxamide and a hydrophobic monomer having limited solubility in water which, when homopolymerized, forms a water-insoluble polymer, which copolymers are capable of thickening the coating color. By "thicken" is meant that the viscosity of the coating color is measurably increased upon the addition of the copolymer thickener thereto when said viscosities are measured using conventional techniques such as set forth in the Examples, particularly Note 2 of Table I.

Of the monomers employed, the $\alpha,\beta$-ethylenically unsaturated carboxylic acids advantageously contain from about 3 to about 8 carbon atoms. Preferred carboxylic acids are generally represented by the formula:

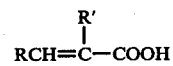

wherein R is —H, —COOX or —$CH_3$ and R′ is —H, an alkyl group having from 1 to about 4 carbon atoms or —$CH_2COOX$ wherein X is —H or an alkyl group having from 1 to about 4 carbon atoms. Preferably, R is —H or —$CH_3$ and R′ is —H or an alkyl group having from 1 to about 4 carbon atoms. More preferably, the unsaturated acid is acrylic or methyacrylic acid with acrylic acid being most preferred. In general, other acids such as itaconic, fumaric, crotonic or aconitic acid and the half esters of a polycarboxylic acid such as maleic acid with $C_1$–$C_4$ alkanols are employed only in combination with acrylic or methacrylic acid.

The ethylenically unsaturated carboxamides are advantageously represented by the following formula:

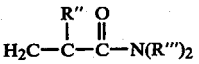

wherein R″ is —H or an alkyl group of 1 to about 4 carbon atoms and each R‴ is individually —H, an alkyl group of 1 to about 4 carbon atoms or a hydroxyalkyl group of 1 to about 4 carbon atoms provided that at least one R‴ is —H. More preferably, the unsaturated carboxamide is methacrylamide or acrylamide, with acrylamide being most preferred.

The hydrophobic monomer employed in preparing the copolymeric thickener is an ethylenically unsaturated monomer which has limited solubility or miscibility in water and which forms a water-insoluble (or immiscible) polymer in water. By the term "limited solubility" is meant that the monomer forms at least about a 1 percent solution in water, without the aid of an additional solubilizing agent, but less than about a 10 weight percent solution in water at a temperature of about 40° C. By "water insoluble" is meant that when polymerized, the resulting homopolymer has essentially no solubility in water, i.e., forms less than a 1 weight percent aqueous solution, at 40° C. Representative of such monomers are acrylonitrile, methacrylate, vinyl acetate, methyl methacrylate and the like. Preferred of such monomers is acrylonitrile.

The desired viscosity and other desired rheological properties of the coating color are dependent on a variety of factors including the composition of the coating color, e.g., the type and amount of binder and pigment, the coating equipment, the process techniques employed and the paper or paperboard being coated. The ability of the copolymer thickener to affect the rheology and other properties of the coating color will vary depending on the specific monomer and amount of each monomer employed in its preparation. In general, the monomeric components and their amounts are selected on the basis of the desired polymeric properties and the effect these properties have on the coating color. The monomeric components are advantageously selected such that the resulting polymer will impart the desired viscosity increase and other rheological properties to the coating color without deleteriously affecting the other desirable properties of the coating color or articles prepared therefrom.

In general, the desired properties are obtained when the copolymer thickener is composed, in polymerized form, of from about 30 to about 97, preferably from about 35 to about 90, weight percent of the unsaturated acid; from about 1 to about 50, preferably from about 5 to about 40, weight percent of the unsaturated carboxamide and from about 2 to about 70, preferably from about 5 to about 50, weight percent of the hydrophobic monomer, wherein said weight percents are based on the weight of the unsaturated acid, the unsaturated carboxamide and the hydrophobic monomer. More preferably, the copolymer thickener is composed, in polymerized form, of from about 40 to about 85, most preferably from about 45 to about 55, weight percent acrylic acid; from about 15 to about 35, most preferably from about 20 to about 30, weight percent acrylamide and from about 5 to 45, most preferably from 20 to about 30, weight percent acrylonitrile, said weight percents being based on the total weight of the acrylic acid, acrylamide and acrylonitrile. Although the copolymeric thickener can comprise minor amounts, i.e., less than about 10 weight percent of other copolymerizable monomers, such other monomers are not preferably employed in the preparation of the copolymer thickener.

The molecular weight of the copolymers useful as thickeners herein is selected on the basis of the desired polymeric properties. The molecular weight of the polymer, as determined by measuring the viscosity of an aqueous solution of the polymer, is not particularly critical to the practice of this invention. In general, the preferred copolymeric thickeners will have a molecular weight such that the viscosity of the polymer, as a 16 weight percent solution in water, ranges from about 500 to about 15,000, more preferably about 1000 to about 10,000, most preferably approximately 2000 to 6000, cps when said viscosities are measured using a Brookfield viscometer, Model LVT, Spindle No. 5 at 20 rpm and 25° C.

The copolymer thickeners of the present invention are advantageously prepared in the form of an aqueous solution by subjecting an appropriate monomer mixture to solution polymerization techniques in the presence of a free radical initiation means and other optionally employed polymerization aids, e.g., chain transfer agents, chelating agents and the like. In general, the polymerization is conducted under an oxygen-free atmosphere in a reaction diluent of a type and in amounts sufficient to form a solution with the monomer and polymerized products.

The reaction diluents advantageously employed herein are relatively volatile materials and include water and mixtures of water with water-miscible liquids such as the lower alkanols, e.g., methanol, ethanol and propanol, and lower ketones such as acetone and methyl ethyl ketone. Of the foregoing, water and mixtures of water with up to about 20 weight percent of a water-miscible organic liquid are preferred, with water being most preferred. Organic liquids such as tetrahydrofuran, acetone and diethylene glycol methyl ether can also be employed as the reaction diluent but are generally less preferred.

Free radical initiation means include UV light and conventional chemical initiators such as azo compounds (e.g., azobisisobutyronitrile), peroxygens (e.g., t-butyl hydroperoxide, cumene hydroperoxide and hydrogen peroxide), persulfates (e.g., potassium, sodium or ammonium persulfates) and the like. Redox type initiators are also of interest herein. Preferred redox initiators comprise a persulfate initiator and a reducing agent such as a sulfite, bisulfite or metabisulfite, with bisulfites and metabisulfites being preferred. Typically, the initiators are employed in conventionally effective amounts, e.g., from about 0.1 to about 10 weight percent based on the weight of the monomers. In redox initiated polymerizations, the persulfate is generally employed in an amount from about 0.05 to about 4 weight percent and the reducing agent generally employed in an amount from about 0.02 to about 5 weight percent. Often, however, larger amounts of the reducing agent, e.g., up to 25 weight percent based on the total weight of the monomers, may advantageously be employed depending upon the desired molecular weight of the polymer being prepared.

Essentially complete conversion of the polymerized monomers is accomplished in a period of from about 30 minutes to 8 hours at reaction temperatures from about 25° to about 100° C., preferably from about 40° to about 90° C. Due to the exothermic nature of the polymerization reaction, the polymerization media is advantageously cooled to prevent excessive temperatures.

In the practice of this invention, the copolymer thickener is employed in an amount sufficient to thicken the coating color and, advantageously, to impart the desirable rheological properties thereto. The amounts of the copolymer thickener which will impart the most desirable properties to the coating color will vary depending on the specific copolymer thickener employed and the composition of the coating color. In general, the copolymer thickener is advantageously employed in amounts from about 0.01 to about 4, preferably from about 0.05 to about 2, more preferably from about 0.1 to about 1, weight percent based on the weight of the pigment and binder.

The thickened coating color of this invention is readily prepared by mixing an aqueous solution of the copolymer thickener with the coating color. The viscosity of the resulting mixture will increase rapidly with coincident changes in rheological properties. Less preferable, the copolymer thickener can be dried and the dry copolymer, generally in the form of a powder or flakes, can be added to the coating color. Upon the dissolution of the copolymer thickener, the viscosity of the coating color increases.

Optionally, the thickened coating color of the present invention may contain adjuncts such as foam-control agents, humectants and the like. Although a dispersing agent is conventionally employed in a coating color to more uniformly disperse the pigment therethrough, in the practice of this invention, the copolymer thickener often sufficiently disperses the pigment such that a dispersing agent need not normally be included in the coating color.

The following examples are presented to illustrate the invention and should not be construed to limit its scope. All percentages and parts are by weight unless otherwise indicated.

EXAMPLE 1

To a suitable size reactor equipped with addition funnel, temperature control means and agitation means is sequentially added 125 parts of an aqueous solution of 20 percent acrylamide, 25 parts of acrylonitrile, 50 parts of glacial acrylic acid and 430 parts of water. The resulting mixture is agitated to obtain a solution of the monomers in water and 0.04 milliliter (ml) of a metal scavenger is added to the resulting monomer solution. Subsequent thereto, the vessel is purged with nitrogen and the monomer solution heated to 60° C. An initiator feed consisting of 0.33 part sodium persulfate, and 0.07 part of tertiary butyl hydroperoxide and 0.66 part of sodium metabisulfite is then added to the heated monomer mixture. The monomer solution is allowed to exotherm which raises the temperature of the monomer solution to about 100° C. in about 1 hour. After reaching this peak temperature, an additional 0.02 part of sodium persulfate is added to the monomer solution. The temperature of the polymerization medium is maintained at about 90° C. for 30 minutes after this addition. At the end of this period, the polymerization medium is cooled to about 80° C. and sufficient amounts of an aqueous solution of 25 weight percent ammonia is added thereto to adjust the pH to about 9.1. The resulting polymeric solution is then cooled to ambient temperatures and found to contain about 16.6 percent polymer solids and exhibits a viscosity of about 10,600 cps when measured using a Brookfield viscometer, Model LVT, Spindle No. 5 at 20 rpm at 25° C.

A coating color is prepared using 100 parts of a kaolin clay (SPS Clay), 12 parts of a binder of a copolymer of styrene and butadiene, 0.5 part (dry) of the thus prepared copolymer thickener and sufficient amounts of water such that the resulting coating color has about 58 percent total solids.

For purposes of comparison, a coating color is prepared using the same formulation except that 0.5 part of a carboxymethylcellulose sold as Cellufix FF-20 by Svensca Cellulose is used to thicken the color (Sample No. C-1). In addition, a coating color is prepared using the same formulation except that 0.5 part of a water-soluble synthetic copolymer of a hydrolyzed polyacrylonitrile with about 50 percent of the nitrile groups being hydrolyzed to acid form sold using the trade name Sterocoll ST by Badische Anilin and Soda Fabrik (BASF) and having a viscosity, as a 16 weight percent solution in water, of about 25,200 cps (measured using a Brookfield viscometer at the conditions hereinbefore described) is employed to thicken the color. As a control, a coating color is prepared using the same formulation except no thickener is employed.

The viscosity of each coating color is determined and each coating color then applied to paper (Bibrist SK-6, 82 g/m$^2$, wood free, bleached, sized to a Cobb of 12 g/m$^2$ water in 10 seconds) to a constant coat weight of about 15 g/m$^2$ using a conventional rod coater. The gloss, brightness, ink absorption and dry pick of the resulting coated paper product is measured. The results of this testing are recorded in Table I.

TABLE I

| COATING COLOR | SAMPLE NO. C | C-1* | C-2* | 1 |
|---|---|---|---|---|
| Thickener (1) | — | CMC | ST | CP |
| Viscosity, | 80 | 340 | 660 | 550 |
| | COATED PAPER PROPERTIES | | | |
| Gloss, 75° (3) | 81 | 75 | 76 | 76 |
| Brightness (4) | 78.4 | 79.3 | 79.5 | 79.1 |
| K & N Ink Absorption, % Drop (5) | 13.3 | 9.8 | 11.5 | 10.2 |
| IGT Dry Pick, cm/sec (6) | 56 | 51 | 53 | 55 |

*Not an example of this invention.
(1) The thickner is given in abbreviated form with
CMC = carboxymethylcellulose sold as Cellufic FF-20 by Svensca Cellulose.
ST = a water-soluble copolymer thickener of a copolymer of modified hydrolyzed polyacrylonitrile sold as Sterocoll ST by BASF.
CP = a copolymer thickener of 50 parts acrylic acid, 25 parts acrylamide and 25 parts acrylonitrile.
(2) Viscosity of the coating color expressed in centipoise (cps) as determined using a Brookfield viscometer, Model LVT, Spindle No. 5 at 100 ppm and 25° C.
(3) Gloss is the initial 75°gloss of the coated paper measured using a multi-angle glossmeter.
(4) Brightness is the brightness of the original sheet as measured using a Elrepho Brightness Meter made by Zeiss.
(5) K & N Ink Absorption is determined by placing a smear of K & N testing ink on the coated sheet for two minutes after which the excess ink is removed and the brightness of the linked area measured and compared to the brightness before inking, The receptivity value is reported as a percent drop in sheet brightness with larger percentage drop indicating better ink receptivity.
(6) IGT Dry Pick Testing is a determination of the pigment binding power of the color coating. It is conducted pursuant to TAPPI Standard T-499 using IGT medium viscosity ink and 36 kg printing pressure.

As is apparent from Table I, the coating color of the present invention is effectively thickened by the copolymer derived from acrylic acid, acrylamide and acrylonitrile. In fact, at the same thickener concentrations, the coating color comprising this copolymer thickener is greater tha a coating color containing a conventional cellulosic thickener and only slightly less than the coating color thickened by the Sterocoll ST, a copolymer conventionally employed to thicken aqueous based coating compositions. This is definitely unexpected due to the fact that the viscosity of an aqueous solution of the copolymeric thickener is substantially less than the viscosity of an aqueous solution of the Sterocoll ST. Therefore, while the copolymer thickener employed in the preparation of the coating color of this invention can be easily handled, it can also be metered directly to a coating color to immediately and effectively increase the viscosity and otherwise affect the rheology thereof. The addition of the copolymer thickener to the coating color is also not found to deleteriously affect the properties of paper coated using the thickened composition.

Additional coating colors are prepared using various amounts of the copolymer thickener (0.25, 0.75 and 1 part of the copolymer thickener per 100 parts of the kaolin clay). At all such concentrations, the coating color is found to effectively thicken the coating color without deleteriously affecting the properties of the paper coated therewith. When compared to coating colors thickened with an equivalent amount of Sterocoll ST, the thickened coating colors exhibit somewhat lower viscosities but the coated paper products are essentially equivalent.

In addition, a copolymer thickener is prepared by identical techniques except using 0.33 part of persulfate, 0.33 part of metabisulfite and 0.07 part of peroxygen initiator per 100 parts of monomer. The resulting copolymer exhibited a viscosity, as a 16.8 percent solution in water, of about 18,750 cps. A coating color prepared using 0.5 part (dry) of this copolymer per 100 parts of pigment is found to exhibit a viscosity of 480 cps.

An additional copolymer thickener is prepared in an identical manner except using 0.33 part of persulfate, 0.33 part of metabisulfite and 0.13 part of peroxygen initiator per 100 parts of monomer. This copolymer exhibits a viscosity, as a 16.6 percent aqueous solution, of about 6,600 cps. Surprisingly, upon the preparation of a coating color using 0.5 part (dry) of the copolymer per 100 parts of pigment, the resulting thickened composition exhibits a viscosity of 465 cps, thereby indicating that the thickening effect of the copolymer is not primarily due to the viscosity and/or molecular weight of the polymer.

A copolymer thickener is also prepared by the method employed in preparing the copolymer used in Sample No. 1 except that 0.67 part of persulfate, 0.33 part of metabisulfite and 0.13 part of peroxygen initiator is employed and sufficient amounts of ammonia are added to the monomer solution to increase the pH thereof to about 6. The resulting copolymer exhibits a viscosity, as a 16.8 percent solution in water, of about 2500 cps. A coating color prepared using about 0.5 part (dry) of the copolymer per 100 parts of pigment exhibiting a viscosity of about 450 cps, again indicating that the viscosity increase of the coating color is not predictable from the viscosity of the copolymer in water.

EXAMPLE 2

A copolymer is prepared from 25 parts acrylamide, 25 parts acrylonitrile and 50 parts acrylic acid using the polymerization techniques outlined in Example 1 except that 0.33 part of persulfate, 0.42 of metabisulfite and 0.06 part of peroxygen initiator are employed per 100 parts of monomer. The copolymer exhibits a viscosity, as a 16 percent aqueous solution, of about 3000 cps. The resulting polymer is formulated with a kaolin clay and a binder of copolymer of styrene and butadiene to prepare a thickened coating color (Sample No. 1) having 57.4 percent total solids and a pH of 9 using 0.5 part of the copolymer thickener and 12 parts of the binder per 100 parts of pigment. The resulting coating color exhibited a viscosity of 500 cps and imparted desirable properties to paper coated therewith.

When subjected to high shear viscosity testing using a Hercules high shear viscometer, the thickened coating color maintained a relatively constant viscosity of about 50 mPa's over a relatively long time period of about 10 minutes, thereby indicating the composition to be relatively stable to shear.

The thickened coating color is also treated for pseudo viscosity behavior at a pseudo shear rate of $10^5$ sec$^{-1}$ using an A. Parr K.G. capillary viscometer (10 mm in length and an inside diameter of 0.3 mm) and found to exhibit a pseudo viscosity of 110 mPa's. For purposes of comparison, the pseudo viscosity of an identical coating color except containing 0.5 part of a copolymer of ethylacrylate, vinyl acetate and acrylic acid (Sample No. C) exhibited a high shear, psuedo viscosity of only about 81.6 mPa's. The comparatively higher psuedo viscosity of the coating color of this invention (Sample No. 1) is surprising in that when tested at low shear on a Brookfield viscometer, Model LVT, Spindle No. 5 at 100 rpm and 25° C., the viscosity is only 465 cps, whereas the viscosity of the composition which is not an example of this invention (Sample No. C) is 750 cps. The high shear psuedo viscosity of the coating color of this invention is also found to be greater than the high shear, pseudo viscosity of an identical coating color except having a carboxymethylcellulose thickener.

A copolymer is prepared in the identical manner employed to prepare the copolymer thickener used in preparing Sample No. 1 of this Example except that it is derived from 50 parts acrylamide, 25 parts acrylic acid and 25 parts acrylonitrile. It has a viscosity, as a 16 percent solution in water, of 14,900. A coating color (Sample No. 2) identical to Sample No. 1 except thickened with 0.5 part of this copolymer per 100 parts of binder exhibits a viscosity of 670 cps and imparts desirable properties to paper coated therewith.

Alternatively, a coating color thickened with a homopolymer of acrylic acid exhibits relatively poor high shear viscosity, with the viscosity continuously dropping with time and shear. A coating color thickened with a copolymer of 75 parts acrylic acid and 25 parts acrylonitrile is relatively more stable to shear, but does not impart the desired dry pick properties to a paper coated therewith.

Copolymers of acrylic acid and acrylamide having no hydrophobic monomer polymerized therein are also not found to be suitably employed in preparing the thickened coating color of this invention due to the undesirable binding power of the coating.

The polymerization product derived from 50 parts acrylonitrile, 25 parts acrylamide and 25 parts acrylic acid using identical techniques is found to be cloudy, with the polymer and aqueous liquid settling into two phases. The addition of the resulting copolymer to a coating color produces a shock reaction, thereby making the copolymer unsuitable for use in the preparation of a thickened coating color. The shock is believed to be due to the large amounts of polymerized acrylonitrile in the polymer. A copolymer prepared from 50 parts acrylonitrile and 50 parts acrylic acid also produces a shock reaction upon its addition to a coating color. A copolymer prepared from 50 parts acrylonitrile and 50 parts acrylamide is found to be insoluble in water and cannot be suitably employed as a thickener herein.

EXAMPLE 3

A thickened coating color is prepared by admixing 85 parts of kaolin clay (SPS clay), 15 parts of titanium dioxide, 18 parts of a binder of a copolymer of styrene and butadiene and 0.5 part (dry) of a copolymer thickener similar in all respects to Sample No. 1 of Example 2 to form a thickened coating color having about 55 percent total solids. The resulting coating color is applied as a pre- and top-coat to a surface sized white lined 250 g/m$^2$ base board at a constant coat weight of approximately 15 g/m$^2$ (7 g/m$^2$ pre-coat; 8 g/m$^2$ top-coat) using a Belflex rod coater at a speed of 40 m/min (Sample No. 1).

In the same manner, comparative coated papers are prepared using coating colors thickened in one instance with the copolymer sold as Sterocoll ST by BASF (Sample No. C-1) and in another instance with carboxymethylcellulose (Sample C-2). The resulting coated paper articles are evaluated for dry and wet pick, K&N ink absorption, brightness and smoothness. The results of this evaluation are set forth in Table II.

TABLE II

| Coating Color | SAMPLE NO. C-1* | C-2* | 1 |
|---|---|---|---|
| Thickener (1) | ST | CMC | CP |
| | COATED PAPER PROPERTIES | | |
| Dry Pick, m/sec (3) | 2.05 | 1.98 | 2.2 |
| Wet Pick, m/sec (4) | 2.5 | 2.0 | 3.0 |
| K & N Ink Adsorption, % Drop (5) | 21.4 | 19.7 | 20.0 |
| Brightness (6) | 78.2 | 77.7 | 76.8 |
| Parker Print Surf: Smoothness, μ (7) | 3.7 | 3.7 | 3.3 |

*Not an example of this invention.
(1) Same as in Table I.
(2) The coating color thickener with CMC is prepared at 53 percent total solids and applied at 7.5 g/m$^2$ pre-coated and 7.5 g/m$^2$ top-coat.
(3) Same as (6) in Table I.
(4) Wet pick is tested in accordance with TAPPI Standard T-499 except that the test strip is predampened via a rubber squeegee prior to printing and the test strip is compared against standards.
(5) Same as (5) in Table I.
(6) Same as (4) in Table I.
(7) Smoothness is the variation in coating thickness per a given length.

As evidenced by the data in the foregoing Table II, paper coated with the thickened coating color of this invention exhibits excellent properties. In fact, said coated paper exhibits more superior dry and wet pick than the paper coated with a coating color thickened with either Sterocoll ST or carboxymethylcellulose. In addition, paper treated with the thickened copolymer thickener is mottle free and exhibits excellent runability properties.

EXAMPLE 4

A high solids carbonate matt coating is prepared at 78 percent total solids using 100 parts of calcium carbonate, 15 parts of a latex binder and 0.5 part (dry) of a copolymer identical to the copolymer employed in preparing Sample No. 1 of Example 2. The resulting thickened coating color exhibited a viscosity of about 3000 cps (Brookfield viscometer, Model LVT, Spindle No. 5 at 100 rpm and 25° C.). When applied to paper using a blade coater with a blade angle of about 22, the paper is found to have essentially no coating streaks and the blade tip is very clean with no spots of dried coating. Comparatively, paper treated with an identical coating color except thickened with 0.5 part of carboxymethylcellulose using a blade angle of 12°, is found to have many fine streaks throughout the paper surface. In addition, the blade tip has several spots of dry coating color.

Paper coated with a coating color comprising a mixture of Dinkie A (60 parts), Satin White (25 parts) and calcium carbonte (15 parts) thickened with the copolymer thickness employed in preparing Sample No. 1 of Example 2 is found to exhibit similarly desirable coatings. A similarly thickened low weight control gravure coating performs equally effectively in preparing a coating paper article.

What is claimed is:

1. A thickened coating color comprising (a) a coating color of an aqueous dispersion of a pigment and a binder therefor and (b) a water-soluble copolymer, different from the binder, comprising, in polymerized form, an $\alpha,\beta$-ethylenically unsaturated carboxylic acid, and ethylenically unsaturated amide and a hydrophobic monomer having limited solubility in water which, when homopolymerized, forms a water-insoluble polymer, said water-soluble copolymer being employed in amounts sufficient to thicken the coating color.

2. The composition of claim 1 wherein the hydrophobic monomer is acrylonitrile, methyl acrylate, vinyl acetate or methylmethacrylate.

3. The composition of claim 2 wherein the unsaturated acid is acrylic acid, the unsaturated carboxamide is acrylamide and the hydrophobic monomer is acrylonitrile.

4. The composition of claim 3 wherein the copolymer thickener consisting essentially of, in polymerization form, from about 30 to about 97 weight percent acrylic acid, from about 1 to about 50 weight percent acrylamide and from about 2 to about 70 weight percent of acrylonitrile, said weight percents being based on the weight of the acrylic acid, acrylamide and acrylonitrile.

5. The composition of claim 4 wherein the copolymer thickness consisting essentially of, in polymerized form, from about 40 to about 85 weight percent acrylic acid, from about 15 to about 35 weight percent acrylamide and from about 5 to about 45 weight percent of acrylonitrile, said weight percents being based on the weight of the acrylic acid, acrylamide and acrylonitrile, and the copolymer thickener is employed in amounts from about 0.01 to about 4 weight parts per 100 weight parts of the pigment.

6. The composition of claim 5 wherein the copolymer thickener consisting essentially of, in polymerized form, from about 45 to about 55 weight percent acrylic acid, from about 20 to about 30 weight percent acrylamide and from about 20 to about 30 weight percent of acrylonitrile, said weight percents being based on the weight of the acrylic acid, acrylamide and acrylonitrile, and the copolymer thickener as employed in amounts from about 0.1 to about 1 weight part per 100 weight parts of the pigment.

7. The composition of claim 4 wherein from about 10 to about 30 weight parts of the binder are employed per 100 weight parts of the pigment.

8. The composition of claim 7 wherein the coating color comprises from about 30 to about 75 percent total solids and the binder is a water-insoluble polymer latex.

9. Paper coated with the coating color of claim 4.

* * * * *